US005927079A

United States Patent [19]

Sekiya et al.

[11] Patent Number: 5,927,079

[45] Date of Patent: Jul. 27, 1999

[54] STIRLING REFRIGERATING SYSTEM

[75] Inventors: Hiroshi Sekiya, Ota; Eiji Fukuda, Gunma-ken, both of Japan

[73] Assignee: Sanyo Electric Co., Ltd., Moriguchi, Japan

[21] Appl. No.: 08/969,487

[22] Filed: Nov. 13, 1997

[30] Foreign Application Priority Data

Nov. 15, 1996 [JP] Japan ..... 8-318553

[51] Int. Cl.[6] ..... F25B 9/00

[52] U.S. Cl. ..... 62/6; 60/520

[58] Field of Search ..... 62/6; 60/520

[56] References Cited

U.S. PATENT DOCUMENTS

| | | | |
|---|---|---|---|
| 3,845,624 | 11/1974 | Roos | 60/517 |
| 4,583,364 | 4/1986 | Wood | 60/520 |
| 4,717,405 | 1/1988 | Budliger | 62/6 |
| 4,843,826 | 7/1989 | Malaker | 62/6 |
| 5,333,460 | 8/1994 | Lewis et al. | 62/6 |
| 5,461,859 | 10/1995 | Beale et al. | 60/517 |
| 5,642,622 | 7/1997 | Berchowitz et al. | 62/6 |

*Primary Examiner*—Ronald Capossela

*Attorney, Agent, or Firm*—Oblon, Spivak, McClelland, Maier & Neustadt, P.C.

[57] ABSTRACT

A Stirling refrigerating system comprising a freezing chamber, a Stirling refrigerator, and a heat carrying means including a pipe arrangement thermally connected to a cooling portion of the Stirling refrigerator so as to carry low temperature heat of the cooling portion to the freezing chamber by means of a refrigerant, wherein when the Stirling refrigerator is driven, the refrigerant circulates in the freezing chamber and the cooling portion through the pipe arrangement. Thus, it is possible to obtain a Stirling refrigerating system in which not only it can cope with the current flon regulation but also it can use ethyl alcohol or the like as a refrigerant other than HCFC or HFC which may be subjected to legal regulation in the future, and it can increase the refrigerating capacity and improve the coefficient of performance in comparison with the existing system.

2 Claims, 6 Drawing Sheets

STIRLING REFRIGERATING SYSTEM

BACKGROUND OF THE INVENTION

1. Field of the Invention

The present invention relates to a Stirling refrigerating system using a Stirling refrigerator, and particularly relates to a Stirling refrigerating system which is suitable for preservation of meat such as tuna, or long term preservation of cells, tissue, blood, etc., and which is large in size and capable of providing very low temperature.

2. Description of the Related Art

As a refrigerating system suitable for preservation of meat such as tuna, or for long-term preservation of cells, tissue, blood, etc., for example, a refrigerating system using flon as a refrigerant is known.

To cope with the recent flon regulation, a refrigerating system using HCFC (hydrochlorofluorocarbon) or HFC (hydrofluorocarbon), which is a CFC replacing material, is known.

In such conventional systems, however, there have been problems as follows.

First, in the refrigerating system using specified flon, that is, CFC (chlorofluorocarbon) as a refrigerant, the use of the specified flon is restricted by the flon regulation.

Also in the case of the refrigerating system using HCFC or HFC, there is a possibility that HCFC and HFC may be a subject of legal regulation in the future. In addition, there has been a problem that in view of the characteristics of the refrigerating system, its coefficient of performance is low and its energy efficiency is poor.

Therefore, it has been requested to develop a refrigerating system which has no fear that it will be subjected to such legal regulation, and which can refrigerate and preserve large-size frozen articles properly.

SUMMARY OF THE INVENTION

It is therefore an object of the present invention to solve the foregoing conventional problems.

It is another object of the present invention to provide a Stirling refrigerating system which can properly cope with not only the flon regulation but also the HCFC/HFC regulation, which will become effective in the future, and which is high in coefficient of performance and in energy efficiency.

In order to attain the foregoing objects, a Stirling refrigerating system according to a first aspect of the present invention comprises a freezing chamber, a Stirling refrigerator, and a heat carrying means including a pipe arrangement thermally connected to a cooling portion of the Stirling refrigerator so as to carry low temperature heat of the cooling portion to the freezing chamber by means of a heat transfer fluid such as a refrigerant, wherein when the Stirling refrigerator is driven, the refrigerant circulates in the freezing chamber and the cooling portion through the pipe arrangement.

According to a second aspect of the present invention, in the Stirling refrigerating system according to the above first aspect, liquid or gas such as ethyl alcohol, nitrogen, helium or the like, is used as the refrigerant.

Further, according to a third aspect of the present invention, in the Stirling refrigerating system according to the above first aspect, heat radiation of the Stirling refrigerator is performed by a water cooling system or an air cooling system.

That is, the Stirling refrigerating system according to the present invention uses a Stirling refrigerator so that not only it can cope with the current flon regulation but also it can use ethyl alcohol or the like as a refrigerant other than HCFC or HFC which may be subjected to legal regulation in the future, and it can increase the refrigerating capacity and improve the coefficient of performance in comparison with the existing system.

DETAILED DESCRIPTION OF THE PREFERRED EMBODIMENTS

Referring to the accompanying drawings, embodiments of the present invention will be described in detail hereunder.

A first embodiment of the present invention will be described with reference to FIGS. 1 to 5.

Figure 1:
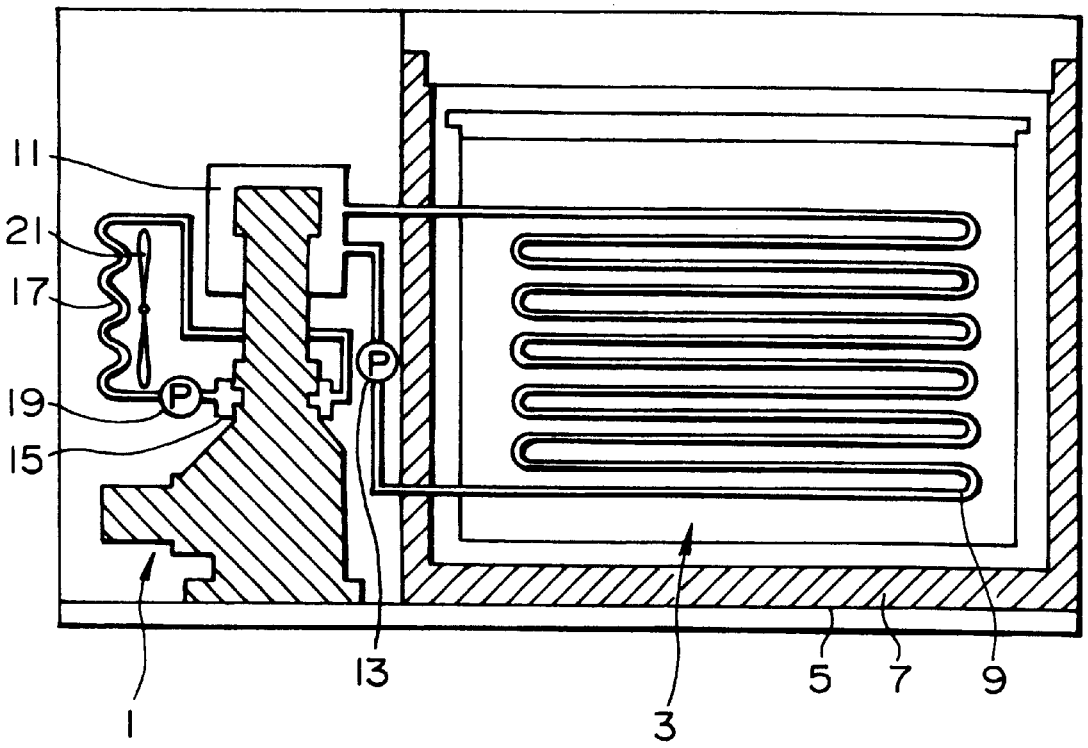
FIG. 1 is a conceptual view illustrating the configuration of the Stirling refrigerating system according to a first embodiment of the present invention.

FIG. 1 is a view illustrating a conceptual configuration of the Stirling refrigerating system according to this embodiment. In the drawing, the reference numeral 1 represents a Stirling refrigerator. A freezing chamber 3 is disposed so as to be adjacent to this Stirling refrigerator 1. This freezing chamber 3 is constituted by a case 5, an adiabatic wall 7 provided on each of inside peripheral walls of this case 5, and a thermal refrigerant pipe arrangement 9 disposed in the peripheral portions inside the adiabatic wall 7 and thermally connected to a cooling portion of the Stirling refrigerator so as to carry low temperature heat of the cooling portion into the case 5 of the freezing chamber 3 by means of a refrigerant.

FIG. 1 schematically shows the thermal refrigerant pipe arrangement 9 so as to be disposed on one side of the adiabatic wall 7 in the freezing chamber 3. In a practical system, however, the pipe arrangements is disposed on all the sides of the adiabatic wall 7 in the freezing chamber 3 at suitable intervals in accordance with the refrigerating capacity of the freezing chamber 3, except one side where an open-close door (not shown) is provided to store objects to be refrigerated and preserved in the freezing chamber 3.

A refrigerant cooling portion 11 is provided in the upper end portion of the Stirling refrigerator 1 in FIG. 1. The thermal refrigerant pipe arrangement 9 described above is connected to this refrigerant cooling portion 11. A thermal refrigerant carrying pump 13 is provided in the thermal refrigerant pipe arrangement 9.

In addition, a heat radiation portion 15 is provided on the Stirling refrigerator 1. A radiator 17 is connected to this heat radiation portion 15. A water pump 19 is inserted in the radiator 17. The reference numeral 21 in FIG. 1 represents an air-cooling fan.

Figure 2:
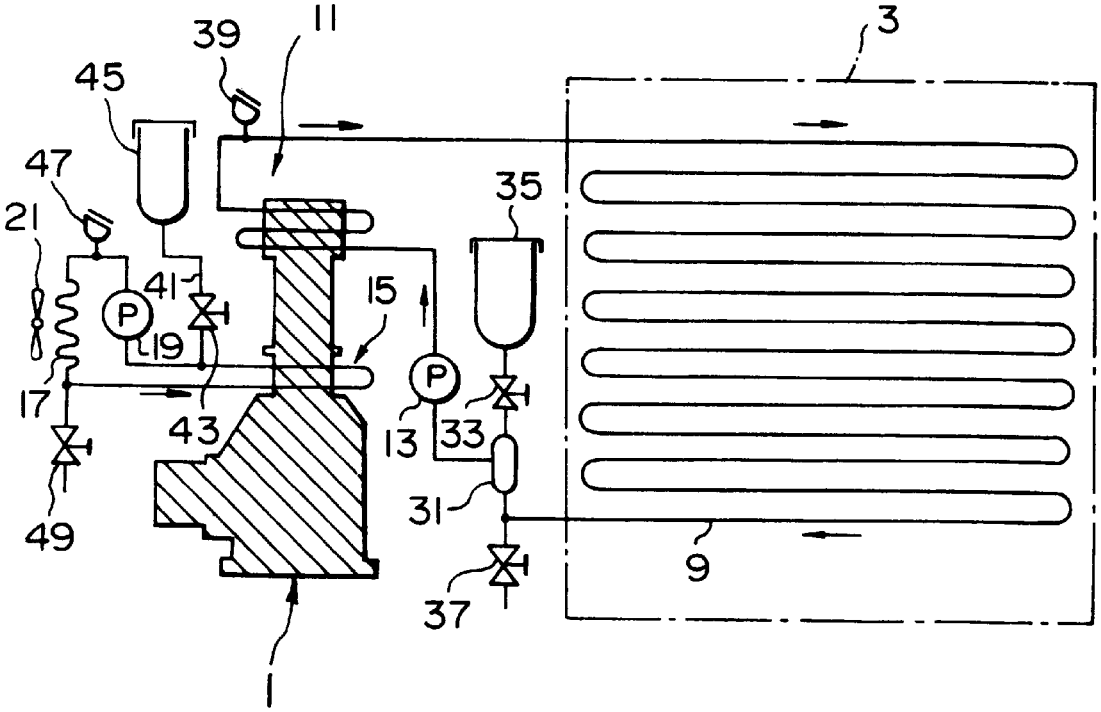
FIG. 2 is a system view illustrating the configuration of the Stirling refrigerating system according to the first embodiment of the present invention.

The Stirling refrigerating system thus configured is systematically shown in FIG. 2. First, a suction tank 31 is disposed between the thermal refrigerant pipe arrangement 9 and the thermal refrigerant carrying pump 13. A thermal refrigerant reservoir tank 35 is connected to this suction tank 31 through a reservoir valve 33. A drain valve 37 is connected to the suction tank 31. In addition, an air vent 39 is connected to the thermal refrigerant pipe arrangement 9 in the refrigerant cooling portion 11.

In addition, a pipe arrangement 41 is branched out from the radiator 17, and a water reservoir tank 45 is connected to this pipe arrangement 41 through a reservoir valve 43. In addition, not only an air vent 47 but also a drain valve 49 are connected to the radiator 17. In addition, in the case of this embodiment, ethyl alcohol (for example, ethanol, the melting point of which is −114° C.) or the like may be used as the refrigerant.

Next, the configuration of the Stirling refrigerator 1 will be described with reference to FIGS. 3 and 4.

In a Stirling refrigerator 1 in this embodiment, a known compressor, for example, a semi-hermetic compressor is used as its driving portion. First, the compressor side will be described.

Figure 3:
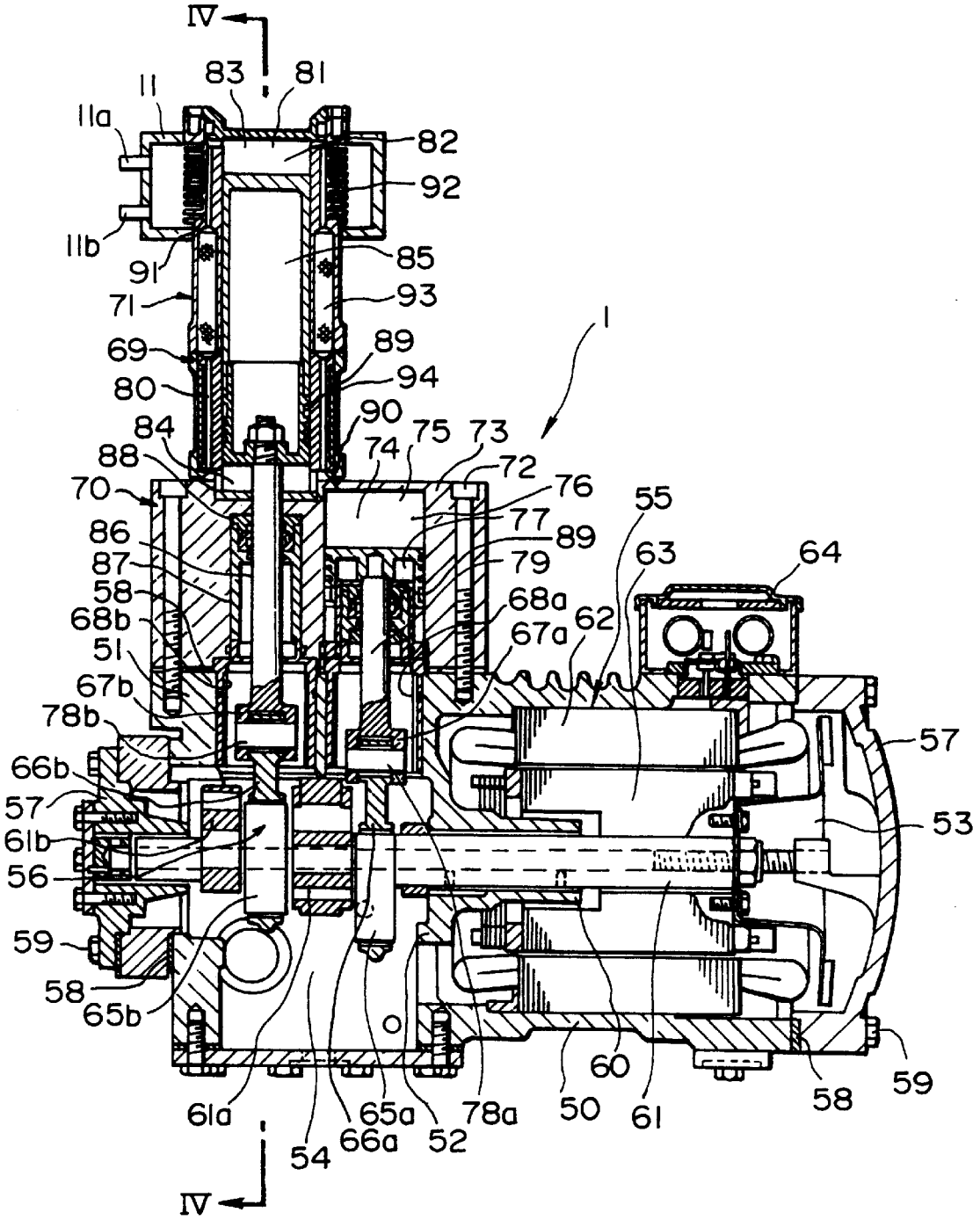
FIG. 3 is a vertical sectional view illustrating the configuration of the Stirling refrigerator according to the first embodiment of the present invention.
Figure 4:
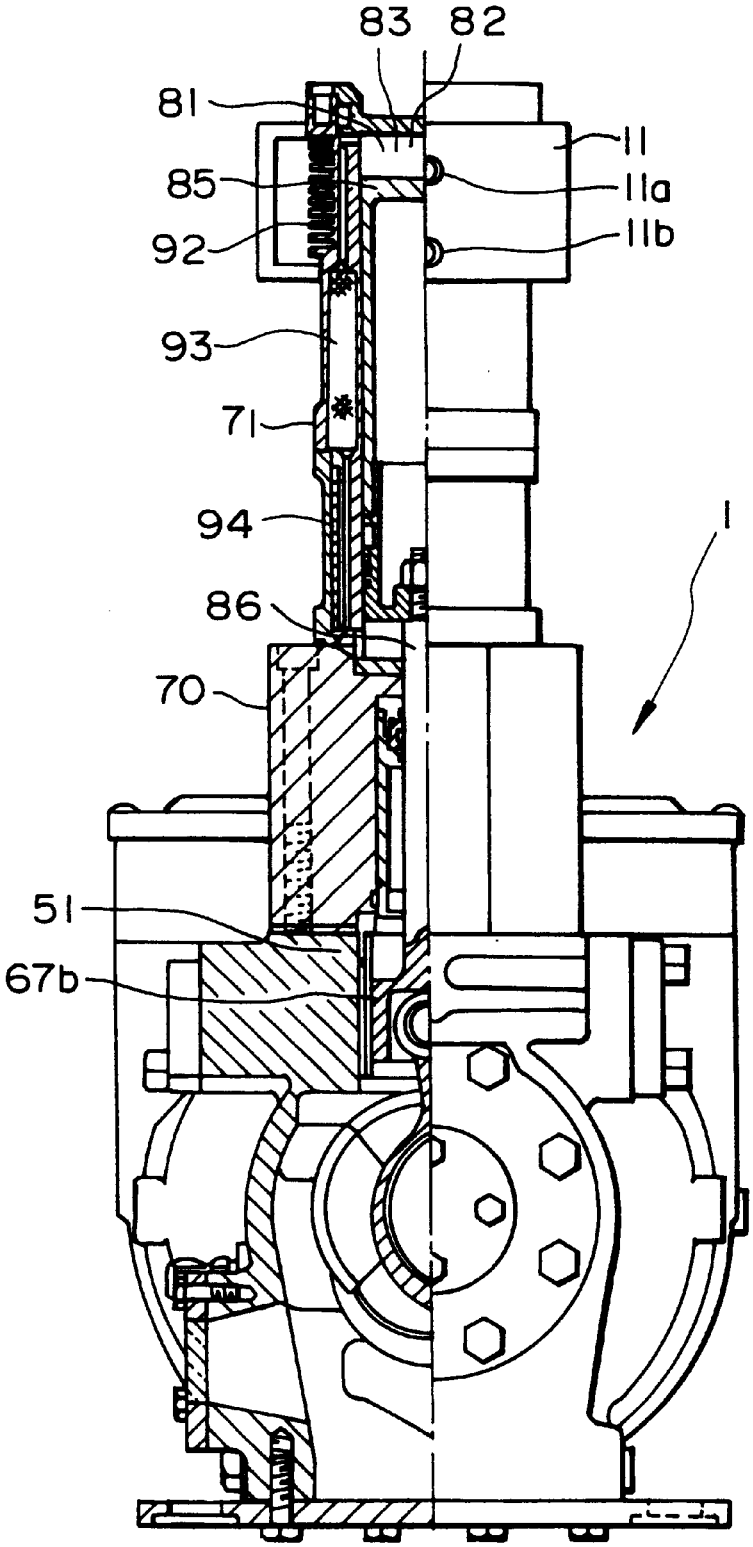
FIG. 4 is a partially cut-off view illustrating the refrigerator in the first embodiment of the present invention, when viewed from the direction IV—IV of FIG. 3.

As shown in FIGS. 3 and 4, the reference numeral 50 represents a housing formed of a casting and having a cylinder 51. This housing 50 is sectioned into a motor chamber 53 and a crank chamber 54 by a partition wall 52. A motor element 55 is disposed in the motor chamber 53, and a mechanism portion 56 for converting rotational motion into reciprocating motion is disposed in the crank chamber 54. In the case of using the compressor as a semi-hermetic compressor, this mechanism portion 56 functions as a compression element.

The opening of the motor chamber 53 and the opening of the crank chamber 54 are closed by closing members 57 respectively. These closing members 57 are fixed to the housing 50 respectively through high air-tight gaskets 58 by means of a plurality of bolts 59. In addition, the high air-tight gaskets 58 are interposed between the joint portions of the respective parts so as to serve for sealing.

A crank shaft 61 supported by a bearing portion 60 of the partition wall 52 is provided rotatably in the housing 50. The motor element 55 is constituted by a stator 62 fixed to the inner circumferential wall of the motor chamber 53 of the housing 50, and a rotor 63 provided rotatably on the inner circumferential side of this stator 62. The crank shaft 61 is fixed to the center of the rotor 63. The reference numeral 64 represents a terminal box, which connects the motor element 55 to an external power supply (not shown).

The mechanism portion 56 is constituted by crank portions 65*a* and 65*b* of the crank shaft 61 extended into the crank chamber 54, connection rods 66*a* and 66*b* connected to these crank portions 65*a* and 65*b*, and cross guide heads 67*a* and 67*b* attached to the heads of these connection rods 66*a* and 66*b*. The mechanism portion 56 functions as a driving means for the Stirling refrigerator portion which will be described later. In addition, balance weights 61*a* and 61*b* for balancing with the Stirling refrigerator portion are attached to the crank shaft 61. The cross guide heads 67*a* and 67*b* are provided reciprocatingly in cross guide liners 68*a* and 68*b* provided in the inner wall of the cylinder 51 of the housing 50. The cylinder 51 functions as cross guide for guiding the cross guide heads 67*a* and 67*b*. The crank portions 65*a* and 65*b* are formed with the phase difference of 90°.

A Stirling refrigerator portion 69 is constituted by a compression cylinder 70 disposed above the crank chamber 54 of the housing 50 and an expansion cylinder 71 disposed on this compression cylinder 70.

The compression cylinder 70 is constituted by a compression cylinder block 73 fixed to the housing 50 by means of bolts 72, a compression piston 77 reciprocating in a space 74 of this compression cylinder block 73 to make this space 74 be a compression space 75 and compress it into a high temperature chamber 76, and a compression piston rod 79 having one end fixed to this compression piston 77 and the other end rotatably connected to the cross guide head 67*a* by means of a pin 78*a*. Since the sliding direction of the compression piston 77 reciprocating in the space 74 is reversed at the top dead center and the bottom dead center, the speed becomes zero thereat. Then, near the top dead center and the bottom dead center, the speed of the piston is slow and the quantity of the change in volume per unit time is also small. At the intermediate point when the compression piston 77 moves from the bottom dead center to the top dead center, and moves from the top dead center to the bottom dead center, the speed of the piston is highest and the quantity of the change in volume per unit time due to the movement of the piston is also maximum.

The expansion cylinder 71 is constituted by an expansion cylinder block 80 fixed to the upper portion of the compression cylinder 70 by a bolt (not shown), a displacer piston 85 which slides and reciprocates in a space 81 of this expansion cylinder block 80 so that the upper portion of this space 81 is made to be an expansion space 82 which is expanded into a low temperature chamber 83 while the lower portion of the space 81 is made to be a working space 84, and a displacer piston rod 86 having one end fixed to this displacer piston 85 and the other end rotatably connected to the cross guide head 67*b* by means of a pin 78*b* through the compression cylinder block 73. The displacer piston rod 86 is sealed by a shaft sealing unit 88 disposed in a through hole 87 of the compression cylinder block 73.

The compression piston 77 is 90° behind in phase than the displacer piston 85. In addition, sealing rings 89 are provided on the sliding surfaces of the compression piston 77 and the displacer piston 85 respectively.

Passages 90 for communicating the compression space 75 with the working space 84 are formed in the compression cylinder block 73 and the expansion cylinder block 79 respectively.

A path 91 for communicating the expansion space 82 and the working space 84 is formed in the expansion cylinder block 80. In this path 91, a cooler 92 for cooling the outside, a cool accumulator 93, and a radiator 94 (a heat radiation portion 15) are provided in this order.

As working gas for the Stirling refrigerator 1, for example, helium, hydrogen, nitrogen, etc., may be used, and helium is used in the embodiment.

Next, the operation of the Stirling refrigerator 1 will be described.

This Stirling refrigerator 1 is constituted by the "annular arrangement of a heat exchanger with one displacer and one piston".

First, the crank shaft 61 is rotated by the motor element 55, and the crank portions 65*a* and 65*b* in the crank chamber 54 are rotated so that their phases are shifted from each other by 90°. The connection rods 66*a* and 66*b* rotatably connected to the crank portions 65*a* and 65*b* slide so that the cross guide heads 67*a* and 67*b* attached to the heads of the connection rods 66*a* and 66*b* slide reciprocatingly in the cross guide liners 68*a* and 68*b* provided in the cylinder 51. The working gas of the compression space 75 in the compression cylinder block 73 is compressed by the compression piston 77 connected to the cross guide head 67*a* through the compression piston rod 79 when the compression piston 77 moves toward the top dead center. Then, the working gas is introduced into the working space 84 through the passage 90. The working gas introduced into the working space 84 is discharged to the radiator 94 when the displacer piston 85 connected to the cross guide head 67*b* through the displacer piston rod 86 moves downward. The working gas the heat of which is radiated to the outside by the radiator 94 is cooled in the cool accumulator 93, and flows into the expansion space 82 through the cooler 92. Between the working space 84 and the expansion space 82, the working gas is merely moved in the moving direction of the displacer piston 85, and there arises no change in pressure when the working gas is moved between the expansion space 82 and the working space 84. That is, compression or expansion is not produced only by the displacer piston 85.

When the displacer piston 85 comes to the position of 90° toward the bottom dead center and the speed reaches the maximum value, the compression piston 77 reaches the top dead center and the speed becomes zero. When the compression piston 77 moves toward the bottom dead center, its speed is low and the change in increase of the volume of the compression space 75 is small, while the speed of the displacer piston 85 becomes maximum and the change in volume of the working space 84 and the expansion space 82 is large so that the working gas in the working space 84 moves into the expansion space 82. Further, when the displacer piston 85 comes near the bottom dead center, the volume in the expansion space 82 becomes maximum. At that time, the compression piston 77 comes near the intermediate position at the rotation angle 90° toward the bottom dead center, and also the speed becomes maximum. Therefore, when the working gas in the compression space 75 begins to expand so that the pressure of this working gas becomes low, the working gas in the expansion space 82 moves into the compression space 75 instantaneously and begins to expand so as to generate cool temperature.

The working gas cooled in the expansion space 82 is discharged from the expansion space 82 into the cooler 92 when the displacer piston 85 comes to the top dead center to thereby reduce the expansion space 82. The thus discharged working gas exchanges heat with the refrigerant cooling portion 11 in the cooler 92 so as to perform cooling and so as to accumulate heat in the cool accumulator 93, and exchanges heat with water of the heat radiation portion 15 in the radiator 94. The working gas then flows into the working space 84, and sucked from the working space 84 into the compression space 75 through the passage 90. Such a cycle is repeated in the same manner, so that the refrigerant cooling portion 11 can be cooled to a very low temperature in a range of from −30° to −200° in the Stirling refrigerator 1.

Although description has been made about the case where the compression piston 77 and the displacer piston 85 have a phase difference of 90°, they can function as a Stirling cycle engine even if the phase difference is set to be in a range of from about 60° to about 120°.

An inlet pipe arrangement 11*a* and an outlet pipe arrangement 11*b* are provided in the refrigerant cooling portion 11 so as to be connected to the thermal refrigerant pipe arrangement 9.

The thermal carriage refrigerant (helium) circulates in the freezing chamber 3 and the refrigerant cooling portion 11 (cooler 92) through the thermal refrigerant pipe arrangement 9. At that time, the refrigerant is cooled in the refrigerant cooling portion 11. Then, passing through the thermal refrigerant pipe arrangement 9, the cooled refrigerant flows into the freezing chamber 3 to thereby cool the freezing chamber 3. The refrigerant flowing in the freezing chamber 3 returns the refrigerant cooling portion 11 again, and is cooled therein. Thus, refrigerant continues the circulation in the same cycles.

On the other hand, in the Stirling refrigerator 1, heat radiation is performed through the heat radiation portion 15 (radiator 94) and the radiator 17.

Figure 5:
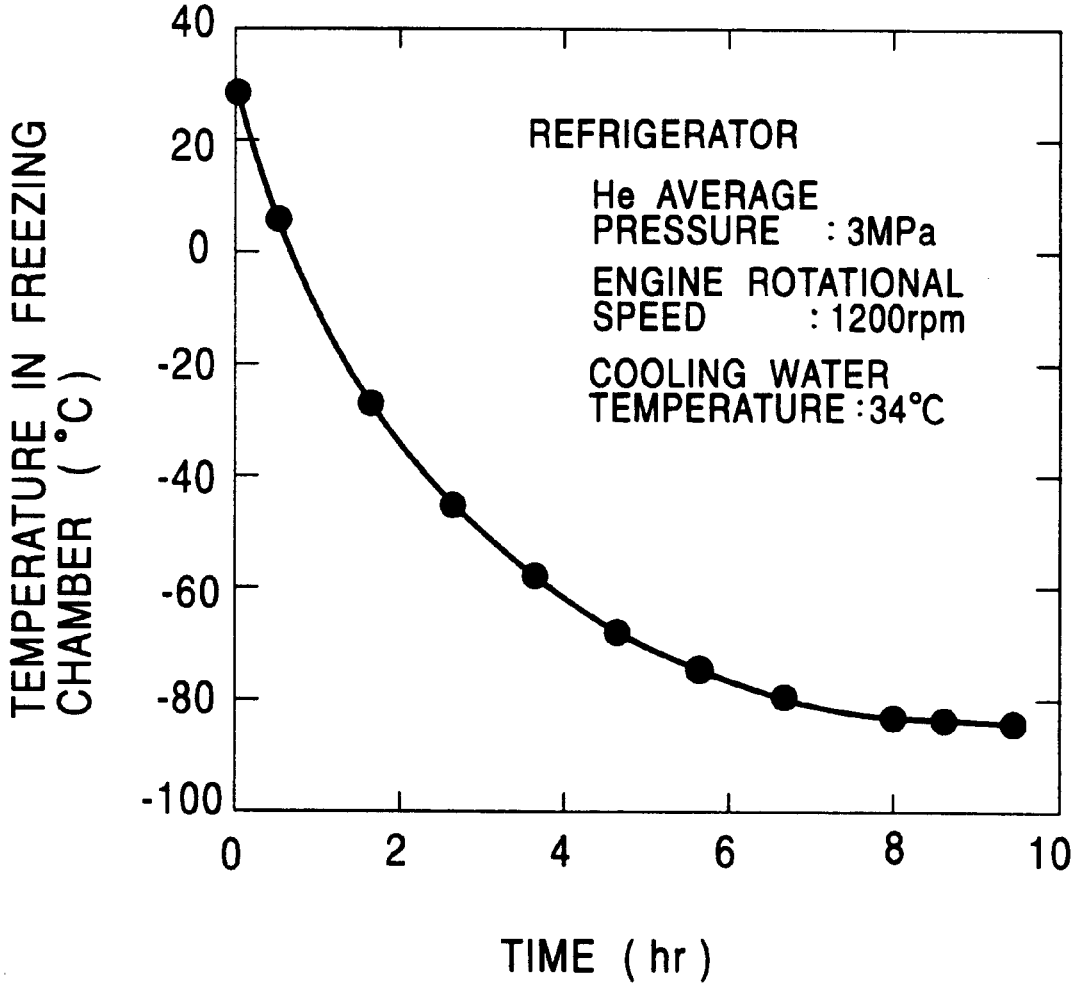
FIG. 5 is a graph showing the pull-down characteristic of the Stirling refrigerating system according to the first embodiment of the present invention.

FIG. 5 shows the pull-down characteristic of the Stirling refrigerating system according to this embodiment. In FIG. 5, the abscissa represents time (hour), and the ordinate represents temperature in the freezing chamber 3, showing the time-base change of the temperature. Then, the average pressure of helium (He) is set to 3 MPa, the rotational speed of the Stirling refrigerator 1 is set to 1,200 rpm, and the temperature of cooling water is set to 34° C.

Figure 6:
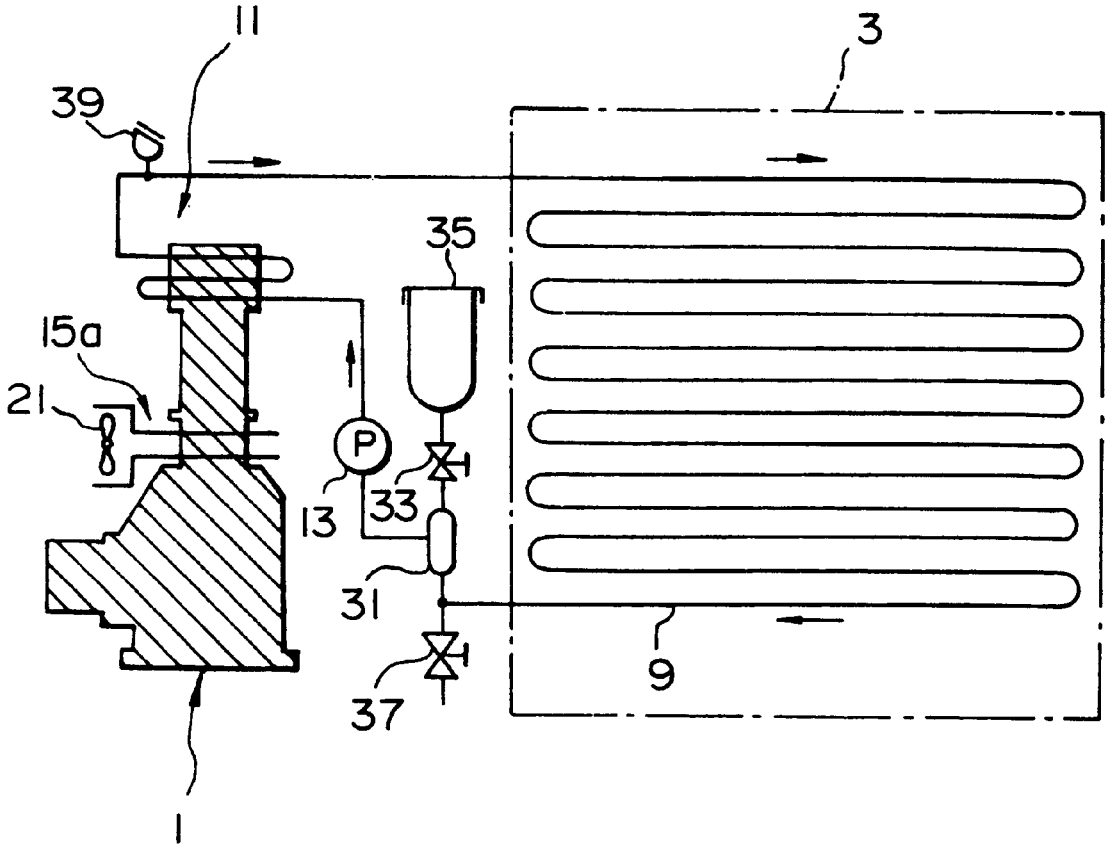
FIG. 6 is a view illustrating the configuration of the Stirling refrigerating system according to a second embodiment of the present invention.

Next, referring to FIG. 6, a second embodiment of the present invention will be described. Although the heat radiation of the Stirling refrigerator is performed by water cooling in the case of the first embodiment, it is performed by air cooling in the case of this second embodiment.

In this second embodiment, since the other configuration is the same as that in the first embodiment, parts the same as those in the first embodiment are referenced correspondingly, and the duplicate description about them will be omitted.

As has been described above in detail, the Stirling refrigerating system according to the present invention, can exhibit the following effects.

(1) since the refrigerating system is configured by use of a Stirling refrigerator, it is possible to provide a refrigerating system in which adequate circulation of the refrigerant is performed in a large-size freezing chamber so that refrigeration and preservation at a required temperature level can be attained by using ethyl alcohol, nitrogen, helium, or the like, as a refrigerant other than flon without requiring any difficulties in configuration of a cooling portion.

It is therefore possible to provide a large-size freezing chamber which can cope with the specified flon (CFC) regulation and which is suitable for long-term preservation of meat such as tuna, organic cells, etc.

(2) The refrigerating system is designed so that the refrigerant circulates through a thermal refrigerant pipe arrangement disposed both in the freezing chamber and the thus configured Stirling refrigerator, and performs heat radiation properly. Accordingly, there is no fear that frost forms as in the case where the refrigerant is supplied to the freezing chamber directly. Since the refrigerant is thus made to circulate and perform heat-radiation suitably, the system is high both in coefficient of performance and energy efficiency.

(3) Further, if the heat radiation of the refrigerator is performed by air cooling, the system can be manufactured at a low price.

What is claimed is:

1. A Stirling refrigerating system comprising a freezing chamber, a Stirling refrigerator, and a heat carrying means including a pipe arrangement thermally connected to a cooling portion of said Stirling refrigerator so as to carry low temperature heat of said cooling portion to said freezing chamber by means of a heat transfer fluid comprising at least one of ethyl alcohol, nitrogen and helium, wherein when said Stirling refrigerator is driven, the heat transfer fluid circulates in said freezing chamber and said cooling portion through said pipe arrangement.

2. A Stirling refrigerating system according to claim 1, wherein heat radiation of said Stirling refrigerator is performed by a water cooling system or an air cooling system.

* * * * *